United States Patent [19]

Frank

[11] Patent Number: 4,646,669

[45] Date of Patent: Mar. 3, 1987

[54] SAILING CANOE KIT

[76] Inventor: Mark S. Frank, 1525 13th St., Los Osos, Calif. 93402

[21] Appl. No.: 773,550

[22] Filed: Sep. 9, 1985

[51] Int. Cl.[4] ..... B63H 9/06

[52] U.S. Cl. ..... 114/39; 114/102; 114/347; 114/363

[58] Field of Search ..... 114/39, 61, 162, 165, 114/90, 91, 92, 363, 102, 103

[56] References Cited

U.S. PATENT DOCUMENTS

| | | | |
|---|---|---|---|
| 1,567,090 | 12/1925 | Thorbur | 114/91 |
| 2,712,293 | 7/1955 | O'Higgins | 114/39 |
| 2,748,740 | 6/1956 | Villar | 114/39 |
| 2,756,711 | 7/1956 | Simpson | 114/39 |
| 3,139,057 | 6/1964 | Black | 114/43 |
| 3,349,741 | 10/1967 | Herbst | 114/39 |
| 3,839,979 | 10/1974 | Wassell | 114/61 |
| 3,902,443 | 9/1975 | McDougall | 114/39 |
| 3,922,988 | 12/1975 | Caton et al. | 114/165 |
| 3,941,072 | 3/1976 | Caton et al. | 114/165 |
| 4,442,787 | 4/1984 | Curran et al. | 114/363 |

FOREIGN PATENT DOCUMENTS

| | | | |
|---|---|---|---|
| 935365 | 6/1982 | U.S.S.R. | 114/39 |

*Primary Examiner*—Joseph F. Peters, Jr.
*Assistant Examiner*—Thomas J. Brahan
*Attorney, Agent, or Firm*—Daniel C. McKown

[57] ABSTRACT

A kit for converting a small boat, such as a canoe, into a sail boat provides a mast support, leeboards, hiking seats, and a rudder assembly. All of these parts are attached to the boat without the need to permanently alter the boat. The mast assembly provides the option of tilting the mast in the fore and aft direction, and the rudder is mounted along one side of the boat. Both the rudder and the leeboards may be deliberately raised from their normal operating positions to permit the boat to be beached. Also, both the leeboards and the rudder are yieldably biased to their normal operating positions, but pivot upwardly and rearwardly upon colliding with an underwater obstacle, to prevent them from being damaged. After the obstacle has been passed, the leeboards and the rudder resume their normal operating position.

2 Claims, 6 Drawing Figures

FIG. 2
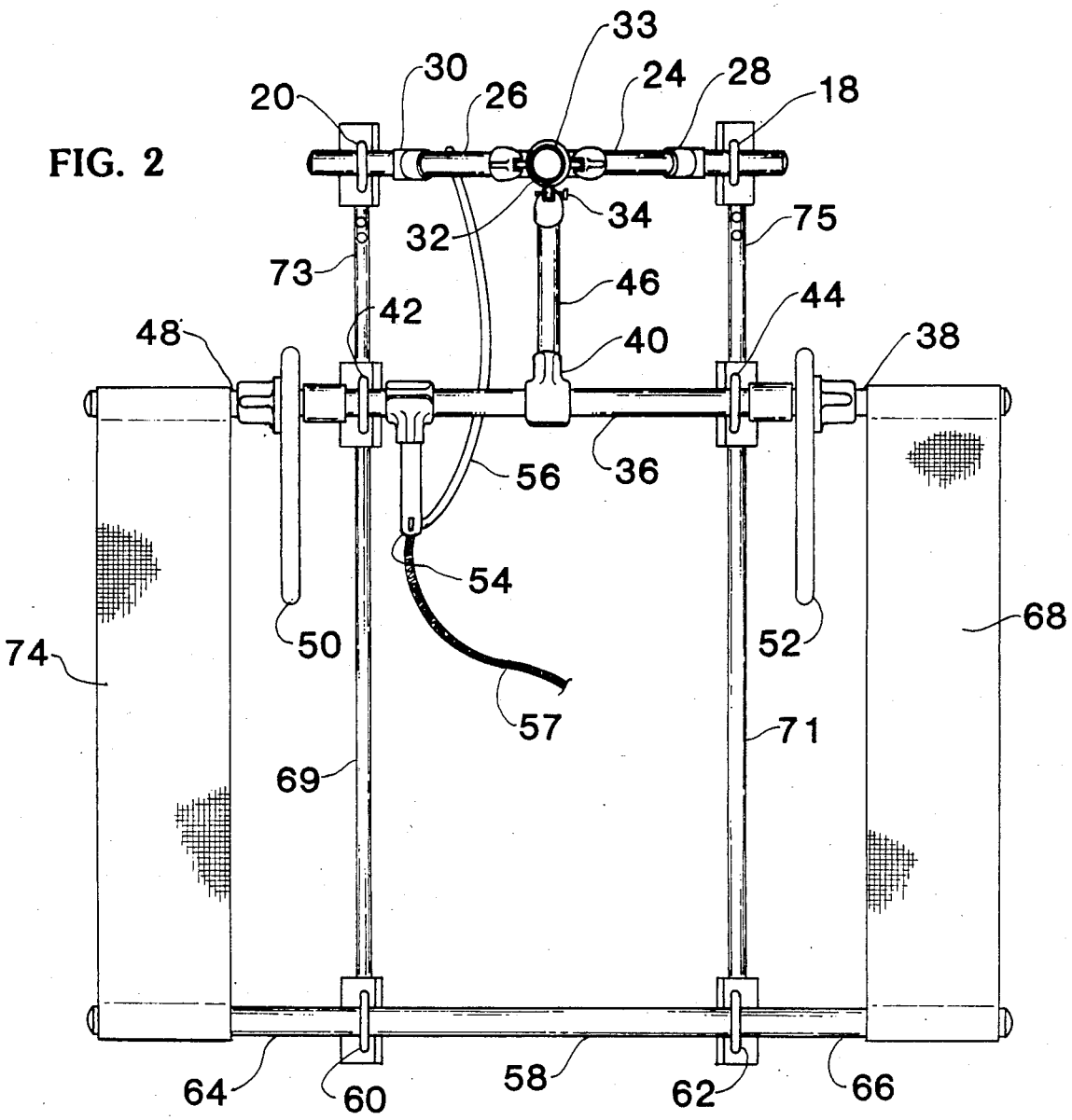
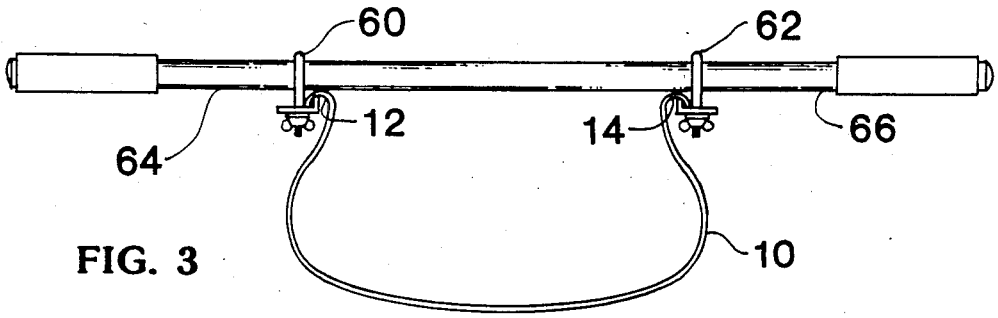
FIG. 3

SAILING CANOE KIT

BACKGROUND OF THE INVENTION

1. Field of the Invention

The present invention is in the field of boating and more specifically relates to a kit for converting a conventional canoe into a sailing canoe. The kit provides a mast assembly, a rudder assembly, leeboards and a hiking seat. The conversion to sailing canoe can be made readily and without any permanent modifications to the canoe.

2. The Prior Art

In U.S. Pat. No. 3,041,994 issued July 3, 1962, Brodie shows a kit for converting a small boat into a sail boat. His mast support and rudder assemblies are quite different from those used in the present invention, and no hiking seat is provided.

In U.S. Pat. No. 3,777,690, Garber shows a stabilizing outrigger for use with a canoe. The outrigger includes a sail, and a rudder assembly is located at one side of the canoe.

A kit sail rig for canoes has been marketed by Northern Star Products, Inc., of St. Paul, Minn. It includes a centered rudder, a braced mast assembly, and leeboards, but lacks the hiking seat and several other features found in the present invention. Also, there is no indication that the mast can be tilted in the fore and aft direction.

Another kit is made by Old Town Canoe Company of Old Town, Me. It also uses a centrally located rudder and provides no hiking seat. The mast support structure is entirely different from that of the present invention and requires permanent modifications to the boat.

Another conversion kit is made by Grumman Allied Industries, Inc. of Marathon, N.Y. This kit appears to be an accessory for that company's line of canoes and requires factory installation. In contrast, the kit of the present invention can be applied to any small boat having rails along its sides and can be installed by the purchaser in a matter of minutes.

The specific advantages of the present invention over kits of the prior art will be described in greater detail below.

SUMMARY OF THE INVENTION

The present invention is a kit for converting a canoe or other small boat into a sail boat without permanently altering the boat or permanently attaching anything to it. A single kit fits any style, length or width canoe, and the structure formed by the kit can be adjusted and mounted to the canoe in such a manner as to provide optimum sailing characteristics for that specific canoe. It is necessary only that the boat or canoe have rails that extend along the sides of the boat and to which the structures of the present invention are removably attached. The structures provided by the kit of the present invention distribute the major loads along the rails, which are the strongest part of the boat.

The mast support system of the present invention is quite robust and it permits an initial adjustment to be made to establish a desired tilt of the mast in the fore and aft direction.

Both the leeboards and the rudder are yieldably biased to their normal operating positions, so that upon striking an obstacle, the leeboards and the rudder pivot upwardly and rearwardly to clear the obstacle. Thereafter, the leeboards and the rudder return to their normal operating position without intervention by the user.

In accordance with the present invention, the rudder is mounted on one side of the boat, and this permits the rudder assembly to be used with canoes or boats of any shape. Further, the rudder assembly of the present invention permits the rudder itself to be positioned on either side of the boat. Also, the longitudinal position of the rudder can be selected at will.

In accordance with the present invention, no shrouds are used to support the mast, and this permits the mast to rotate through 360 degrees without limitations.

In accordance with the present invention, the kit provides a hiking seat that consists of a sling of fabric extending longitudinally and spanding the space between two laterally-extending cross members.

The mast support assembly consists of a first cross member to which a mast tube is affixed perpendicularly. The mast tube is supported laterally by two diagonal braces which extend from the first cross member to the mast tube. The first cross member is mounted to the rail of the boat at either side. Thus, lateral loading of the mast tube is distributed through the braces and the first cross member to the rails of the boat.

Longitudinal support for the mast tube is provided by another diagnonal brace which extends forwardly and upwardly from a second cross member that is spaced from the first cross member and that is also attached to the rails of the boat. This diagonal brace is pivotably connected to the mast tube to accommodate tilting of the mast in the fore and aft direction. Initially, this tilt of the mast can be selected and set by adjusting the longitudinal spacing between the first cross member and the second cross member before those cross members are secured to the rail. Normally, the tilt of the mast in the fore and aft direction would be set at the beginning of a day's sailing in relation to the prevailing wind conditions.

A third cross member located aft of the second cross member and spaced from it is used to provide a support for the hiking seat or seats. In accordance with the present invention, the hiking seat is connected between the second cross member and the third cross member, and such a seat may be provided on either or both sides of the boat.

In accordance with the present invention, the leeboards are mounted on the second cross member and can be pivoted about the axis of the second cross member either deliberately by use of a crank, or through contact with an underwater obstacle. The leeboards are yieldably biased to their normal operating position, but the biasing force can be overcome by the force exerted by an obstacle, thereby causing the leeboards to pivot upwardly about the axis of the second cross member.

In accordance with the present invention, the rudder assembly includes a first shaft that extends laterally across the boat and beyond the rails. At one end of the shaft and perpendicularly to it is mounted a sleeve. A second shaft passes through this sleeve and is rotatable within it.

When the rudder strikes an underwater obstacle, rotation about the axis of the first shaft occurs as the rudder is pivoted rearwardly and upwardly. Rotation about the axis of the second shaft results during normal steering of the boat. Like the leeboards, the rudder is yieldably biased to its normal operating position, so that it will return to that position after being pivoted out of the way by contact with an underwater obstacle. A tiller is connected to the second shaft through a crank.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 2 is a top view showing the mast support, the hiking seats, and the leeboards of the preferred embodiment of FIG. 1;

FIG. 3 is a cross sectional view in the direction 3—3 indicated in FIG. 1;

DETAILED DESCRIPTION OF THE PREFERRED EMBODIMENT

As mentioned briefly above, the kit of the present invention can be used to convert any small boat into a sail boat. It is necessary only that the boat have some kind of a lip or rim (see FIG. 3) that extends along the top of each side of the boat. In the preferred embodiment, various items of the kit are attached to the boat by clamping them to the rails. Normally, the rails are the strongest structural portion of a small boat, and therefore the rails are the ideal place to attach the cross members of the kit. As best seen in FIG. 3, the cross members are attached to the rails through the use of rail clamps. This use of rail clamps is well known in the art.

In other embodiments, other forms of clamps are used to attach the cross members of the kit to the boat.

Although the kit of the preferred embodiment can be attached to any small boat having rails, it is believed that the major use of the kit will be in connection with canoes because of their many advantages for the sportsman. Therefore, it will be understood that when the word canoe is used, it is not used by way of limitation, but merely by way of example.

Figure 1:
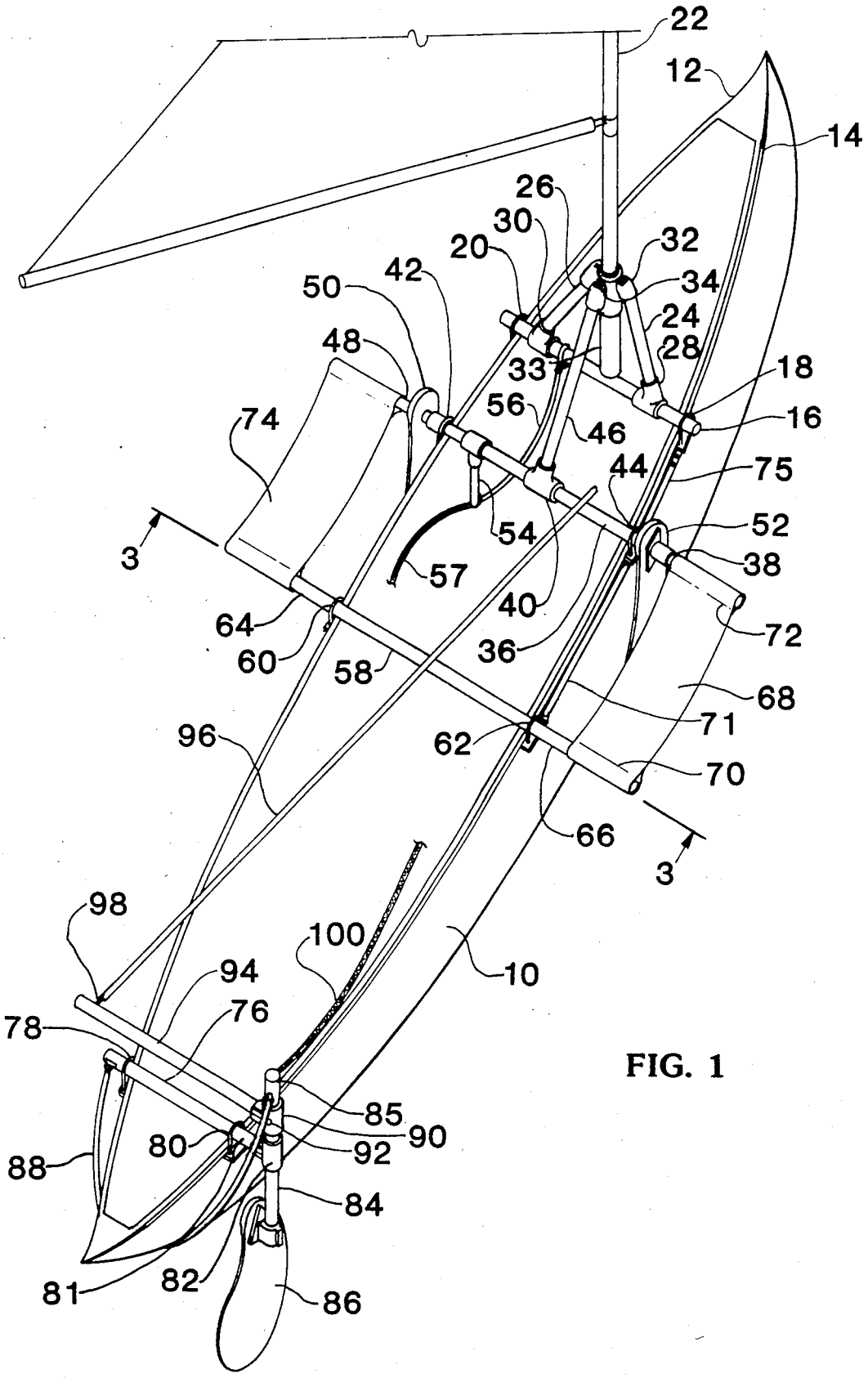
FIG. 1 is a perspective view showing a preferred embodiment of the kit of the present invention installed on a canoe.
Figure 4:
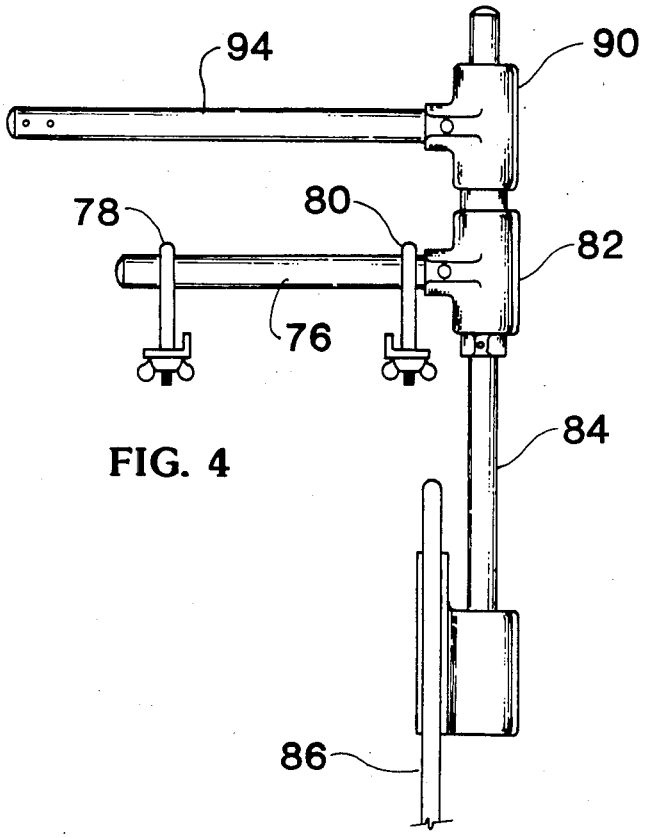
FIG. 4 is an end elevation view of the rudder assembly of the preferred embodiment; and, FIG. 5 is a top view of the rudder assembly of the preferred embodiment.
Figure 5:
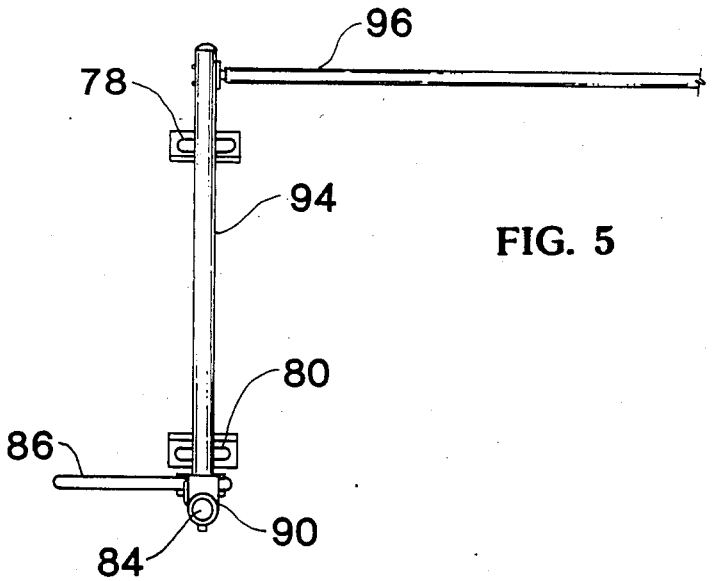

Turning now to the drawings, there is shown in FIG. 1 a perspective view showing a canoe to which the various parts of the kit of the preferred embodiment have been attached. The remaining drawings show the same parts from other views, and thus the same part will be designated by the same reference numeral throughout.

The mast assembly includes a first cross member 16 which is attached by the rail clamps 18, 20 to the starboard rail 14 and to the port rail 12 of the canoe 10. A mast tube 33, into which the mast 22 fits, is attached perpendicularly to the first cross member 16. Lateral support for the mast 22 is provided by the lateral braces 24, 26 which are connected to the first cross member 16 by the fittings 28, 30, respectively. The upper ends of the lateral braces 24, 26 are connected to the mast tube 33 by the fitting 32.

Longitudinal support for the mast 22 is provided by the longitudinal brace 46 that is connected at its lower end through the fitting 40 to the second cross member 36. The fitting 40 is rotatable about the second cross member 36. The upper end of the longitudinal branch 46 is pivotably connected to the fitting 32 by means of the pin 34 in the preferred embodiment. The second cross member 36 is secured to the rails 12, 14 by means of the rail clamps 42, 44 respectively.

If desired, the mast can be tilted in the fore and aft direction by altering the longitudinal location of the second cross member 36 with respect to the first cross member 16. Thereafter, the tilt of the mast 22 may be maintained by tightening the rail clamps 42, 44.

The second cross member 36 includes the outboard portions 38, 48 that extend beyond the rails 14, 12 respectively. The leeboards 50, 52 are mounted on the outboard portions 48, 38 respectively.

The leeboards 50, 52 are adjustably affixed to the second cross member 36 so as to rotate with it. Rotation of the second cross member 36 is facilitated by the crank 54 that is also attached to the second cross member. The leeboards 50, 52 are biased to their desired operating position by an elastic cord 56. When either leeboard 50, 52 strikes an obstacle, as the canoe 10 moves forward, both leeboards are pushed rearwardly and upwardly by the object thereby stretching the elastic cord 56. After the object has been cleared, the elastic cord 56 urges the leeboards to return to their preferred operating position. The rope 57 permits retraction of the leeboards from the operator's usual position on the boat.

In accordance with the present invention, there is also provided a third cross member 58 that is aft of the second cross member 36 and spaced from it. The third cross member is attached to the rails 12, 14 by means of the rail clamps 60, 62. The third cross member 58 is sufficiently long that it includes the outboard portions 64, 66. A sling 68 of fabric is attached to the outboard portion 38 of the second cross member 36 and to the outboard portion 66 of the third cross member 58 and spans the space between those outboard portions to form a hiking seat. In the preferred embodiment, the sling 68 is a rectangular piece of cloth that is hemmed at opposite ends along the lines 70, 72. The hems form passages into which the outboard portions 38, 66 extend. A similar hiking seat is provided on the opposite side of the boat between the outboard portions 48 and 64.

Optional spacers 69, 71 prevent relative movement of the second and third cross members 36, 58. The spacers 69, 71 are attached to the rail clamps 42, 60 and 44, 62 respectively. Other optional spacers 73, 75 prevent relative movement of the first and second cross members 16, 36. The optional spacers 73, 75 are provided with several holes near one end to accommodate the various spacings between the first and second cross members that result when the mast is tilted in the fore and aft direction. The optional spacers 73, 75 are attached to the rail clamps 20, 42 and 18, 44 respectively.

The rudder assembly would normally be mounted towards the stern of the boat, and with the kit of the present invention, the actual location of the rudder assembly may be altered by the user through a wide range of positions.

The rudder assembly includes a cross member 76 that extends laterally across the boat and that rests on the rails 12, 14, and is attached to the rails by the rail clamps 78, 80. An outboard portion 81 of the cross member 76 extends laterally beyond the rail 14. A sleeve 82 is mounted for rotation on the outboard portion 81 of the cross member 76, and the axis of the sleeve lies in a plane that is perpendicular to the axis of the cross member 76. A shaft 84 extends through the sleeve 82. The rudder 86 is attached to the lower portion of the shaft 84, and the upper portion 85 of the shaft 84 extends upwardly beyond the sleeve 82. A crank 94 is connected to the upper portion 85 of the shaft 84 by means of the tee 90 which, in the preferred embodiment includes a set screw 92 for securing the tee fitting 90 to the upper portion 85. A tiller 96 is connected to the crank 94 by a flexible connector 98. The length of the tiller 96 permits the operator to steer the boat from a position near the center of the boat.

An elastic cord 88 attached to the port end of the cross member 76 is brought around the stern of the boat and attached to the upper portion 85 of the shaft 84 under tension. The tension in the elastic cord 88 urges the rudder 86 to its normal operating position. However, the operator can pull on the rope 100 to overcome the tension of the elastic cord 88 and thereby intentionally raise the rudder to permit it from being damaged when the boat is beached or when passing over a shallow streambed. Also, if the rudder comes into contact with an underwater obstacle, the rudder will pivot rearwardly and upwardly from its normal position, about the axis of the cross member 76, to clear the obstacle, after which the rudder will be urged to return to its normal position by the tension of the elastic cord 88.

In the preferred embodiment, a slot in the part of the tee 82 that fits over the end of the cross member 76 limits the downward and forward movement of the rudder, thereby permitting it to be biased against the stop that is provided by the slotted sleeve. In other embodiments, the slotted sleeve is not used, and the elastic cord used for biasing the rudder is slack when the rudder is in its normal operating position.

The normal operating depth of the rudder may be increased or decreased by loosening the set screw 92 and adjusting the position of the shaft 84 within the sleeve 82.

Figure 6:
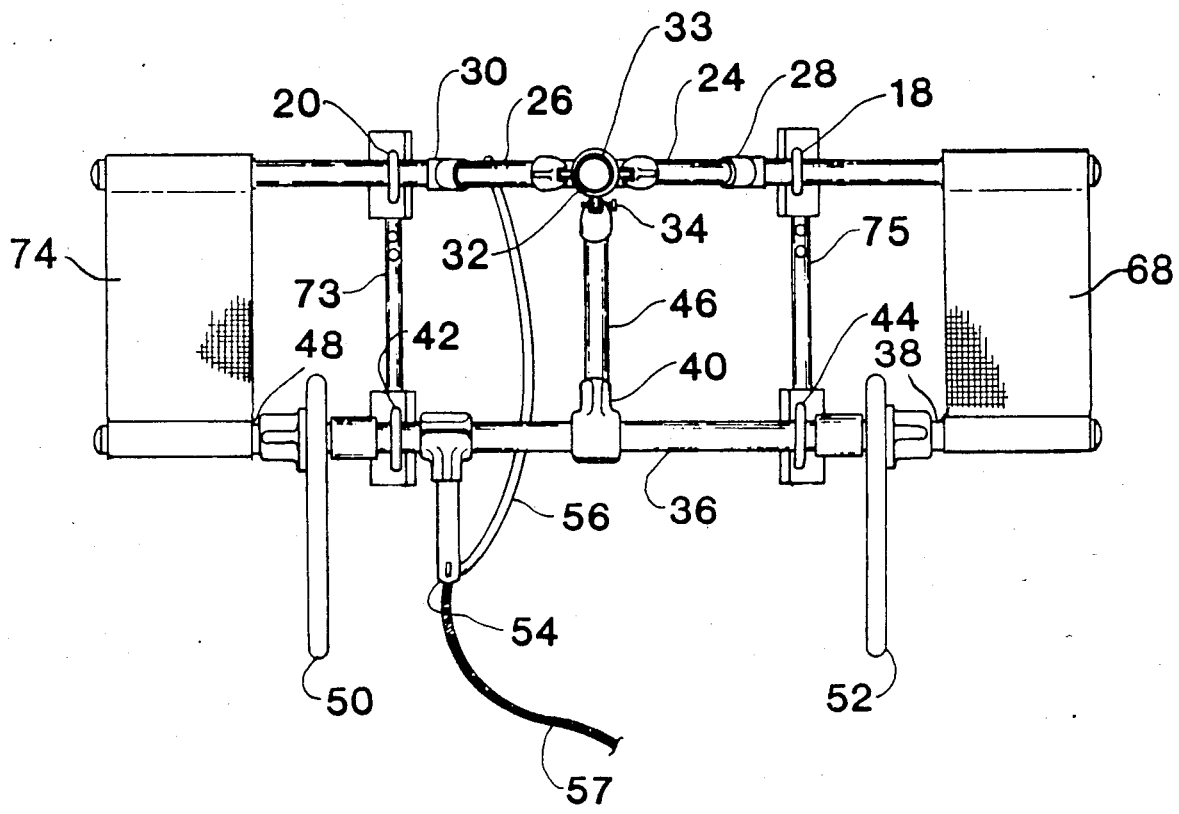
FIG. 6 is a fractional top view showing the mast support and hiking seats in an alternative embodiment.

In the alternative embodiment shown in FIG. 6, the ends of the first cross member 16 extend beyond the rails 12, 14. This permits hiking seats 68, 74 to be attached to the outboard portions of the first and second cross members 16, 36, and in this embodiment the third cross member 58 is omitted.

From the above description it can be seen that the kit of the present invention can be applied to a small boat that has rails and that no permanent modifications of the boat are required. The kit provides a mast assembly, one or two hiking seats, leeboards and a rudder assembly. The leeboards and rudder are yieldably maintained in their normal operating position, but will be displaced by obstacles so as to prevent them from becoming damaged. Further, both the leeboards and the rudder may deliberately be raised, as when the boat is being beached, or when it is passing over shallows.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. Apparatus removably mountable on a small boat, such as a canoe, having rails that extend along its sides, without permanently modifying the boat, for providing a hiking seat and a support for a mast, said apparatus comprising in combination:

a first cross member extending laterally between the rails at a desired longitudinal location of the mast;

a mast tube attached to extend perpendicularly from said first cross member and into which the mast fits;

lateral brace means attached to said first cross member and to said mast tube and extending diagonally between them to provide lateral support for said mast tube;

means for removably pivotably mounting said first cross member to the rails;

a second cross member extending laterally between the rails at a location aft of the mast and having an outboard portion extending laterally beyond the rail on a first side of the boat;

longitudinal brace means having a first end attached to and extending perpendicularly from said second cross member and having a second end pivotably attached to said mast tube for pivotal motion about a lateral axis to provide longitudinal support for said mast tube, and whereby the tilt of said mast in the fore and aft direction can be set initially by setting the longitudinal spacing between said first cross member and said second cross member;

means for removably mounting said second cross member to the rails;

a third cross member extending laterally between the rails at a location aft of said second cross member and spaced from said second cross member, and having an outboard portion extending laterally beyond the rail on the first side of the boat;

means for removably mounting said third cross member to the rails;

a sling having opposite ends affixed to the outboard portions of said second cross member and said third cross member, said sling spanning the space between the outboard portions of said second cross member and said third cross member to form a hiking seat.

2. The apparatus of claim 1 wherein the opposite ends of said sling are hemmed to form passages through which extend the outboard portions of said second cross member and said third cross member.

* * * * *